US005382873A

United States Patent [19]

Scholl et al.

[11] Patent Number: 5,382,873

[45] Date of Patent: Jan. 17, 1995

[54] HIGH-PRESSURE DISCHARGE LAMP WITH INCANDESCING METAL DROPLETS

[75] Inventors: Robert P. Scholl, Aachen; Bernhard R. Weber, Düsseldorf, both of Germany

[73] Assignee: U.S. Philips Corporation, New York, N.Y.

[21] Appl. No.: 975,174

[22] Filed: Nov. 12, 1992

[30] Foreign Application Priority Data

Dec. 4, 1991 [EP] European Pat. Off. ..... 91203169
Mar. 25, 1992 [EP] European Pat. Off. ..... 92200849

[51] Int. Cl.[6] ..... H01J 61/12; H01J 61/82

[52] U.S. Cl. ..... 313/570; 313/607; 313/637; 313/638; 313/641

[58] Field of Search ..... 313/570, 607, 637, 638, 313/634, 639, 641

[56] References Cited

U.S. PATENT DOCUMENTS 3,575,630 4/1971 Edris ..... 313/639
3,886,391 5/1975 Koury et al. ..... 313/638
5,138,227 8/1992 Heider et al. ..... 313/634

FOREIGN PATENT DOCUMENTS 0420335 9/1990 European Pat. Off. .
0492205 12/1991 European Pat. Off. .
59-167948 9/1984 Japan .
59-167949 9/1984 Japan .

OTHER PUBLICATIONS

W. Elenbaas, "High Pressure Mercury Vapour Lamps and their Applications", 1965, Cleaver-Hume Press Ltd. pp. 124–127.

*Primary Examiner*—Michael Horabik
*Assistant Examiner*—N. D. Patel
*Attorney, Agent, or Firm*—Brian J. Wieghaus

[57] ABSTRACT

The high-pressure discharge lamp has a filling in a discharge vessel (1) which includes a rare gas and a metal compound (2) chosen from hafnium halides and zirconium halides. The halide evaporates and discomposes to form incandescent, condensed metal particles. The lamp may be electrodeless and may in addition contain a buffer gas as a component of its filling. Alternatively, the lamp may have internal electrodes (13) and contain mercury (12) as a buffer gas. The lamp has favorable light generating properties, in particular a good color rendering, and in addition may have a very high luminous efficacy.

16 Claims, 1 Drawing Sheet

HIGH-PRESSURE DISCHARGE LAMP WITH INCANDESCING METAL DROPLETS

BACKGROUND OF THE INVENTION

The invention relates to a high-pressure discharge lamp comprising a light transmitting discharge vessel sealed in a gas-fight manner and a filling in said discharge vessel comprising a metal compound and a rare gas, wherein said metal compound evaporates during normal operation and decomposes to form condensed metal particles, or droplets, which generate light by incandescent emission.

Such a high-pressure discharge lamp is known from EP-0 420 335 A2.

In the known lamp, the metal compound is selected from among rhenium oxide, and halides and oxyhalides of tungsten, rhenium and tantalum. Since these compounds are generally aggressive to tungsten bodies, said lamp does not comprise electrodes and is excited at a high frequency of between 0.1 MHz and 50 GHz, although such operation requires an expensive control apparatus to provide such high operating frequencies. The lamp has a useful life of several thousands of hours of operation. This is in contrast to a similar lamp having tungsten electrodes, which would have a life of a few hours only. Electrodes would be attacked by the filling and be destroyed, involving the risk of the lamp vessel being destroyed by explosion.

During operation of the lamp the metal compound evaporates and its vapour dissociates in a hotter region of the discharge, where it arrives by convection and/or diffusion. The metal vapour thus formed condenses to form particles or droplets that are heated to incandescence by the discharge. The particles may migrate to regions of lower temperature and be lost by reaction with halogen and/or oxygen to participate in the cyclic process again.

The advantage of this mechanism of light generation is that the melting point of the light emitting metal is no longer the temperature limit of the incandescent body, as it is the case in ordinary electric incandescent lamps. In lamps of the kind mentioned in the opening paragraph, the incandescent bodies are not in the solid state, at a temperature well below their melting point, but in the liquid state, well above their melting point. This is of interest because at the temperatures concerned the amount of light emitted by a black body is proportional to the fifth power of its temperature. Accordingly, the known lamp contains compounds of tungsten, rhenium or tantalum: the metals having the highest melting points. Only osmium melts at a higher temperature than tantalum. Osmium, however, is dangerous, because it is readily oxidised into a highly toxic oxide.

The luminous efficacy of the known lamp, however, varies from poor to moderate, although efficacies have been obtained which are higher than those ever obtained with incandescent lamps. Its colour rendering index generally is rather high, however, not all standard colours make a high contribution to the light generated. As a result, the light generated has a hint of colour, for example, a hint of green.

SUMMARY OF THE INVENTION

It is an object of the invention to provide a high-pressure discharge lamp of the type described in the opening paragraph which has improved light-generating properties.

According to the invention, this object is achieved in that the metal compound is chosen from the group consisting of halides of hafnium and halides of zirconium.

In dependence on its embodiment, the lamp of the invention has a high to almost excellent colour rendering, the rendering of individual colours being well balanced, and generally a high to very high luminous efficacy, despite the melting points of the metals concerned being much lower (Zr 2125; Hf 2500 K) than those of tungsten (3680), rhenium (3453) and tantalum (3287 K).

It appeared, however, that, other than in ordinary electric incandescent lamps having a solid incandescent body, the melting point of the incandescent metal is of minor importance in a high-pressure discharge lamp of the type concerned. Other factors are of importance, like the possibility to create a cyclic process in which the condensation of particles from a supersaturated vapour takes place. To that end the metal compound must be able to be brought into the gas phase to a sufficient extent, and a supersaturated metal vapour must be created at a temperature below the boiling point of the metal. The higher the boiling point of the metal, the higher the temperature can be at which particles of the metals are existent, and the more efficiently, according to Wien's law, light can be generated. Now, the boiling points of zirconium and hafnium, 4682 and 4876 K, respectively, are considerably lower than those of tungsten, rhenium and tantalum, 5828, 5869 and 5731 K, respectively. It was therefore a surprise to find that the high-pressure discharge lamp of the invention has such favourable properties. It is of importance, too, that the metal compounds used are of low toxicity and not radioactive.

Generally, the lamp of the invention contains the metal compound, for example, a chloride, a bromide, an iodide or a mixture of two or more thereof, in an amount of at least $0.1 * 10^{-6}$ mol/cm$^3$, for example, $5 * 10^{-6}$ mol/cm$^3$.

In a favourable embodiment, the lamp of the invention has no electrodes and the rare gas pressure is no more than 30 mbar at room temperature. The rare gas is used to start the discharge. The filling may contain metal halide additives, for example, alkali metal halides, such as cesium halide, to stabilize the discharge and/or to control the plasma temperature. Such additives hardly contribute to the light generation.

The lamp of this embodiment has an excellent general colour rendering index $Ra_{14}$ and each of its fourteen special colour rendering indices ($R_x$) has a very high value. This is in contrast to the special colour rendering indices of the lamp known from the said EP-0 420 335 A2, whose lowest value is below or equal to 80.

Table 1 provides a comparison of the colour rendering indices of examples $L_1$–$L_3$ of this embodiment with those of examples $E_1$–$E_{11}$ of said EP Patent Application.

In Table 1, $Ra_8$ is the average value of the indices $R_1$–$R_8$; $Ra_{14}$ the average value of all fourteen indices. In each line the lowest R value is underlined. It appears that particularly $R_9$, strong red, is poor in the spectrum of the known lamp, its value being only 80 or lower. The value of $R_9$ is much higher to very high for the lamp of the present invention, particularly in the case of hafnium halide ($L_2$). The colour rendering of the lamps containing zirconium halide ($L_1$ and $L_3$), however, is also very good.

TABLE 1

| lamp | $R_1$ | $R_2$ | $R_3$ | $R_4$ | $R_5$ | $R_6$ | $R_7$ | $R_8$ | $R_9$ | $R_{10}$ | $R_{11}$ | $R_{12}$ | $R_{13}$ | $R_{14}$ | $Ra_8$ | $Ra_{14}$ |
|---|---|---|---|---|---|---|---|---|---|---|---|---|---|---|---|---|
| $L_1$ | 98 | 98 | 98 | 99 | 98 | 97 | 98 | 99 | 97 | 95 | 98 | 95 | 98 | 99 | 98 | 98 |
| $L_2$ | 99 | 98 | 97 | 99 | 99 | 98 | 98 | 99 | 99 | 97 | 98 | 93 | 98 | 98 | 98 | 98 |
| $L_3$ | 99 | 99 | 98 | 98 | 97 | 97 | 98 | 98 | 99 | 98 | 94 | 92 | 99 | 99 | 98 | 98 |
| $E_1$ | 96 | 98 | 93 | 92 | 95 | 99 | 96 | 91 | 77 | 96 | 92 | 99 | 97 | 96 | 95 | 94 |
| $E_2$ | 95 | 93 | 88 | 90 | 95 | 94 | 93 | 91 | 74 | 85 | 91 | 98 | 94 | 93 | 92 | 91 |
| $E_3$ | 94 | 93 | 88 | 91 | 95 | 92 | 93 | 91 | 75 | 94 | 92 | 92 | 93 | 93 | 92 | 90 |
| $E_4$ | 93 | 92 | 88 | 90 | 93 | 92 | 93 | 90 | 69 | 83 | 90 | 92 | 93 | 93 | 91 | 89 |
| $E_5$ | 85 | 75 | 80 | 91 | 87 | 85 | 96 | 87 | 35 | 65 | 91 | 75 | 82 | 94 | 86 | 81 |
| $E_6$ | 92 | 95 | 99 | 95 | 93 | 96 | 96 | 88 | 66 | 92 | 94 | 94 | 93 | 99 | 94 | 92 |
| $E_7$ | 96 | 97 | 100 | 98 | 97 | 99 | 97 | 93 | 80 | 97 | 98 | 96 | 97 | 99 | 97 | 96 |
| $E_8$ | 90 | 94 | 98 | 91 | 90 | 92 | 96 | 87 | 65 | 85 | 90 | 87 | 91 | 99 | 92 | 89 |
| $E_9$ | 94 | 93 | 93 | 95 | 92 | 89 | 96 | 98 | 68 | 83 | 93 | 81 | 92 | 96 | 94 | 90 |
| $E_{10}$ | 95 | 96 | 99 | 97 | 96 | 97 | 98 | 92 | 77 | 95 | 96 | 96 | 96 | 99 | 96 | 95 |
| $E_{11}$ | 91 | 95 | 98 | 91 | 92 | 94 | 98 | 88 | 66 | 88 | 90 | 89 | 92 | 99 | 93 | 91 |

The filling and the luminous efficacy of the lamps $L_1$–$L_3$ of Table 1 are represented in Table 2.

TABLE 2

| | | | | |
|---|---|---|---|---|
| $L_1$ | 500 μg $ZrI_4$ | 70 μg CsI | 13 mbar Ar | 20 lm/W |
| $L_2$ | 550 μg $HfCl_4$ | 50 μg CsCl | 13 mbar Ar | 44 lm/W |
| $L_3$ | 350 μg $ZrCl_4$ | 50 μg CsCl | 13 mbar Ar | 42 lm/W |

Lamps of this embodiment can be used for those applications where a very good to excellent colour rendering is required, such as in studio lighting.

Favourably, the lamp of the aforesaid embodiment is modified to contain a buffer gas as a component of its filling. Generally, the buffer gas will be at a pressure above 1 bar during normal operation of the lamp, more particularly at a pressure between 2 and 40 bar, favourably at about 3 to 12 bar, e.g. 3 to 4.5 bar. As a buffer gas Ar, Xe and/or Hg may be used. Alternatively, nitrogen and, tungsten being absent in the lamp, carbon monoxide and carbon dioxide may be used. The buffer gas does not substantially contribute to the light generation, but increases the total gas pressure and influences the electrical and the thermal conduction of the discharge.

Quite remarkably, it appeared that a considerable increase of the luminous efficacy is obtained compared with the luminous efficacy of the lamp without a buffer gas, while the colour rendering of the light generated remains at a high level. This change is the more remarkable as a similar effect could not be obtained with the known lamp of the said EP Patent Application.

In Table 3, the general colour rendering indices $Ra_8$ and $Ra_{14}$ and the luminous efficacy of examples $L_4$–$L_7$ of the modified embodiment are represented. The corresponding values of examples $L_1$–$L_3$ and of examples $E_1$–$E_{11}$ of said EP Patent Application are given for comparison.

It is evident from Table 3 that the lamps $L_4$–$L_7$ have combinations of colour rendition and luminous efficacy that are generally more favourable than those of the known lamps.

The fillings of the lamps $L_4$–$L_7$ of Table 3 are represented in Table 4.The rare gas pressures given therein are at ambient temperature. During operation the lamps have a pressure above 5 bar.

TABLE 3

| Lamp | $Ra_8$ | $Ra_{14}$ | η (lm/W) |
|---|---|---|---|
| $L_1$ | 98 | 98 | 20 |
| $L_2$ | 98 | 98 | 44 |
| $L_3$ | 98 | 98 | 42 |
| $L_4$ | 92 | 90 | 74 |

TABLE 3-continued

| Lamp | $Ra_8$ | $Ra_{14}$ | η (lm/W) |
|---|---|---|---|
| $L_5$ | 92 | 90 | 71 |
| $L_6$ | 92 | 90 | 72 |
| $E_7$ | 92 | 90 | 53 |
| $E_1$ | 95 | 94 | 59 |
| $F_2$ | 92 | 91 | 67 |
| $E_3$ | 92 | 90 | 57 |
| $E_4$ | 91 | 89 | 49 |
| $E_5$ | 86 | 81 | 35 |
| $E_6$ | 94 | 92 | 65 |
| $E_7$ | 97 | 96 | 46 |
| $E_8$ | 92 | 89 | 27 |
| $E_9$ | 94 | 90 | 5.5 |
| $E_{10}$ | 96 | 95 | 43 |
| $E_{11}$ | 93 | 91 | 65 |

TABLE 4

| | | | | |
|---|---|---|---|---|
| $L_4$ | 550 μg $HfCl_4$ | 50 μg CsCl | 13 mbar Ar* | 1 mg Hg |
| $L_5$ | 550 μg $HfCl_4$ | 50 μg CsCl | 930 mbar Ar* | |
| $L_6$ | 550 μg $HfCl_4$ | 50 μg CsCl | 930 mbar Xe* | |
| $L_7$ | 370 μg $ZrCl_4$ | 50 μg CsCl | 13 mbar Ar* | 3 mg Hg |

In another, very favourable embodiment of the lamp of the invention, the lamp has internal electrodes, preferably of tungsten, and the filling comprises mercury as a buffer gas.

It was found that the filling, which contains zirconium and/or hafnium halide as the metal particle forming and main light generating component, and which may contain additives to stabilize and/or to control the plasma temperature, shows little aggression to tungsten. The metal compounds do not contain oxygen. Oxygen would react with tungsten electrodes. On the contrary, when the lamp contains oxygen as an impurity, this is gettered by hafnium or zirconium to form a very stable compound. Moreover, the metals have a higher affinity to halogen than has rungsten, as a result of which attack of tungsten electrodes by halogen is obviated. Therefore, the lamp has a long life.

Quite surprisingly, the lamp of this embodiment has a very good colour rendering and a high to very high luminous efficacy as well. Examples are represented in Table 5.

TABLE 5

| Lamp | filling* | | $Ra_8$ | $Ra_{14}$ | η (lm/W) | $T_c$ (K) |
|---|---|---|---|---|---|---|
| $L_8$ | 3.3 mg $HfI_4$ | 0.2 mg CsI | 96 | 95 | 63 | 6540 |
| $L_9$ | 2.4 mg $HfBr_4$ | 0.17 mg CsBr | 95 | 94 | 92 | 5210 |
| $L_{10}$ | 1.5 mg $HfCl_4$ | 0.13 mg CsCl | 94 | 92 | 108 | 6240 |
| $L_{11}$ | 2.9 mg $ZrI_4$ | 0.2 mg CsI | 92 | 89 | 61 | 5880 |

*plus 10 mg Hg, 13 mbar Ar at ambient temperature.

The lamp of this embodiment has the advantage that it can be operated on a normal power supply circuitry as is generally used to operate an electroded high-pressure discharge lamp. The lamp is particularly of interest where a good colour rendering and a low heat load are required, such as, for example, for studio lighting.

Apart from a halide of hafnium or zirconium, such as a bromide or an iodide, mixtures may be used, for example, mixtures of hafnium bromide and hafnium iodide.

When the lamp of the invention contains a buffer gas, the molar amount thereof generally is at least equal to the molar amount of the metal compound.

BRIEF DESCRIPTION OF THE DRAWINGS

Embodiments of the lamp of the invention are shown in the drawing, in which.

DESCRIPTION OF THE PREFERRED EMBODIMENTS

Figure 1:
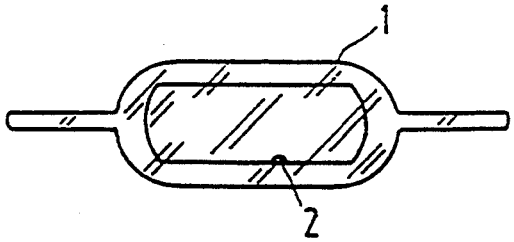
FIG. 1 represents a first embodiment in side elevation.

In FIG. 1, the high-pressure discharge lamp has a light-transmitting discharge vessel 1, which is sealed in a gas-tight manner. The discharge vessel shown consists of quartz glass and is cylindrical in shape. It has an inner diameter of approximately 5 mm and an inner length of approximately 13 mm. The discharge vessel contains a filling comprising a metal compound and a rare gas. During normal operation the metal compound evaporates and decomposes to form condensed metal particles which generate light by incandescent emission. The metal compound 2 is chosen from the group consisting of halides of hafnium and halides of zirconium.

The lamp shown does not contain electrodes. The lamp was made having several fillings, for example, to constitute each of the lamps $L_{1-7}$ of Tables 1–4. The lamps were operated at a frequency of 2.45 GHz and consumed a power of 80 W, but 60 W in the case of $L_3$.

Figure 2:
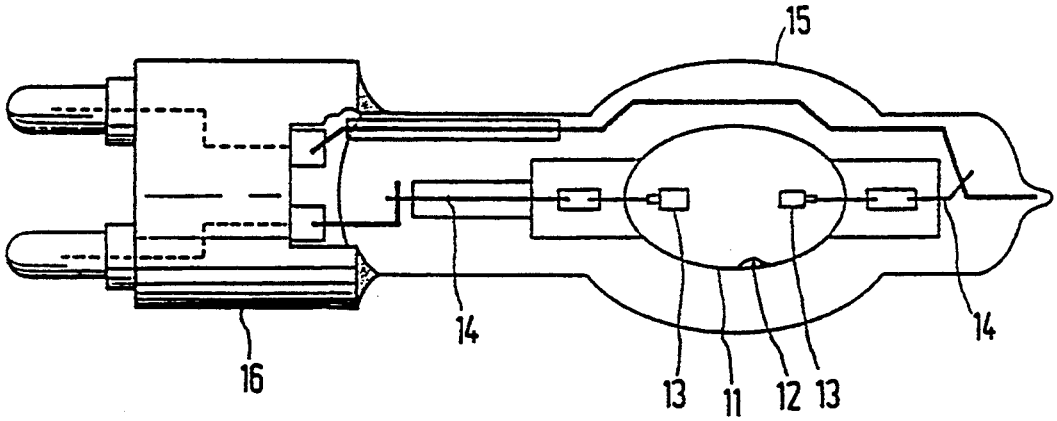
FIG. 2 a second embodiment in side elevation.

In FIG. 2, the lamp vessel 11 of quartz glass has an elliptical shape and a volume of approximately 1 $cm^3$. Tungsten electrodes 13 are present in the discharge vessel, about 10 mm spaced apart. Current supply conductors 14 to the electrodes penetrate into the discharge vessel. The lamp has a filling comprising a rare gas, a buffer gas and a metal compound 12 selected from halides of hafnium and halides of zirconium. The lamp was made with several fillings comprising mercury (12) as a buffer gas, for example, to constitute each of the lamps $L_8$–$L_{11}$ of Table 5. The lamp vessel 11 is mounted within an outer envelope 15, which is provided with a lamp base 16. Operated at a frequency of 50 Hz, these lamps consumed a power of 212, 274, 342 and 186 W, respectively.

We claim:

1. A high-pressure discharge lamp comprising a light transmitting discharge vessel sealed in a gas-tight manner and a filling in said discharge vessel comprising a metal compound and a rare gas, wherein said metal compound evaporates during normal operation and decomposes to form condensed metal particles which generate light by incandescent emission, characterized in that:

the metal compound is chosen from the group consisting of halides of hafnium and halides of zirconium.

2. A high-pressure discharge lamp as claimed in claim 1, characterized in that the lamp has no electrodes and the rare gas is at a pressure of no more than 30 mbar at room temperature.

3. A high-pressure discharge lamp as claimed in claim 1, characterized in that the lamp has no electrodes and contains a buffer gas as a component of its filling.

4. A high-pressure discharge lamp as claimed in claim 3, characterized in that the buffer gas is at a pressure above 1 bar during normal operation.

5. A high-pressure discharge lamp as claimed in claim 4, characterized in that the pressure of the buffer gas is between 2 and 40 bar.

6. A high-pressure discharge lamp as claimed in claim 5, characterized in that the buffer gas is chosen from argon, xenon and mercury.

7. A high-pressure discharge lamp as claimed in claim 1, characterized in that the lamp has internal electrodes and the filling comprises mercury as a buffer gas.

8. A high-pressure discharge lamp as claimed in claim 4, characterized in that the buffer gas is chosen from argon, xenon and mercury.

9. A high-pressure discharge lamp as claimed in claim 3, characterized in that the buffer gas is chosen from argon, xenon and mercury.

10. An electrodeless high pressure discharge lamp, comprising:

a light transmissive discharge vessel sealed in a gas-tight manner, said discharge vessel being free of discharge electrodes therein; and a discharge sustaining filling within said discharge vessel, said filling comprising a rare gas at a pressure of no more than 30 mbar at room temperature, a metal compound chosen from the group consisting of halides of hafnium and halides of zirconium, and a buffer gas at a pressure of between 2 and 40 bars during lamp operation, during lamp operation with a stable discharge, said metal compound undergoing a cycle by which it evaporates and decomposes to form condensed metal droplets, the metal droplets being heated by the discharge to incandescence by which the droplets emit light.

11. An electrodeless high pressure discharge lamp according to claim 10, wherein said buffer gas is chosen from the group consisting of argon, xenon, mercury, nitrogen, carbon monoxide and carbon dioxide.

12. An electrodeless high pressure discharge lamp according to claim 11, wherein said lamp has a color rendering $Ra_{14}$ of at least about 90 and a luminous efficacy (lumens per watt) of at least about 71.

13. An electroded high pressure discharge lamp, comprising:

a light transmissive discharge vessel sealed in a gas-tight manner, said discharge vessel including a pair of opposing tungsten discharge electrodes between which a gas discharge takes place during lamp operation; and a discharge sustaining filling within said discharge vessel, said filling comprising a rare gas at a pressure of no more than 30 mbar at room temperature, a metal compound chosen from the group consisting of halides of hafnium and halides of zirconium, and a buffer gas at a pressure of between 2 and 40 bars during lamp operation, during lamp operation with a stable discharge between said tungsten discharge electrodes, said metal compound undergoing a cycle by which it evaporates and decomposes to form condensed metal droplets, the metal droplets being heated by the discharge to incandescence by which the droplets emit light.

14. An electroded high pressure discharge lamp according to claim 13, wherein said buffer gas comprises mercury.

15. An electroded high pressure discharge lamp according to claim 14, wherein said lamp has a color rendering $Ra_{14}$ of at least about 89 and a luminous efficacy (lumens per watt) of at least about 61.

16. An electroded high pressure discharge lamp according to claim 14, wherein said lamp has a color rendering $Ra_{14}$ of at least about 92 and a luminous efficacy (lumens per watt) of at least about 92.

* * * * *